United States Patent [19]

Hurst

[11] 3,957,011

[45] May 18, 1976

[54] KICK-UP/STEERING CAMMING FEATURE FOR INBOARD-OUTBOARD MARINE DRIVE

[75] Inventor: John W. Hurst, Port Huron, Mich.

[73] Assignee: Chrysler Corporation, Highland Park, Mich.

[22] Filed: July 17, 1975

[21] Appl. No.: 596,781

[52] U.S. Cl. ..... 115/41 R

[51] Int. Cl.[2] ..... B63H 5/12

[58] Field of Search ..... 115/34 R, 35, 41 R, 115/41 HT

[56] References Cited

UNITED STATES PATENTS 3,339,517 9/1967 Bergstedt ..... 115/41 R

*Primary Examiner*—Duane A. Reger
*Assistant Examiner*—Jesus D. Sotelo
*Attorney, Agent, or Firm*—Talburtt & Baldwin

[57] ABSTRACT

A camming surface on the inner peripheral edge of the transom opening limits steering angle of the I/O power leg as it is tilted up. Full steering is permitted at lower tilt positions and limited steering is permitted at raised positions. This arrangement makes the unit more adaptable to various size transoms, affords a neater appearance and reduces weight and cost.

6 Claims, 6 Drawing Figures

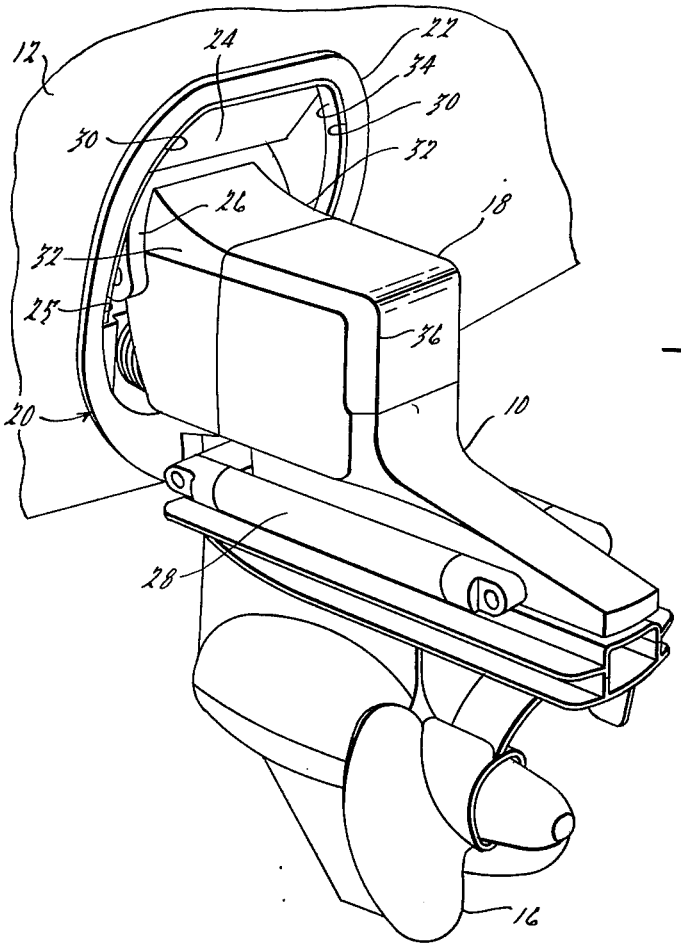
FIG. 1.
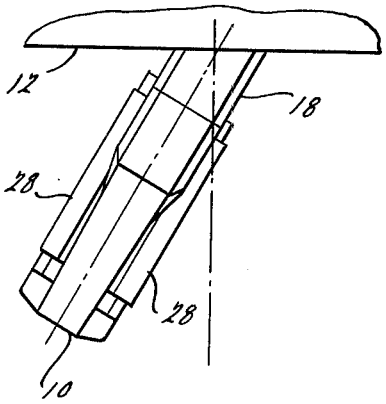
FIG. 3.
FIG. 2.
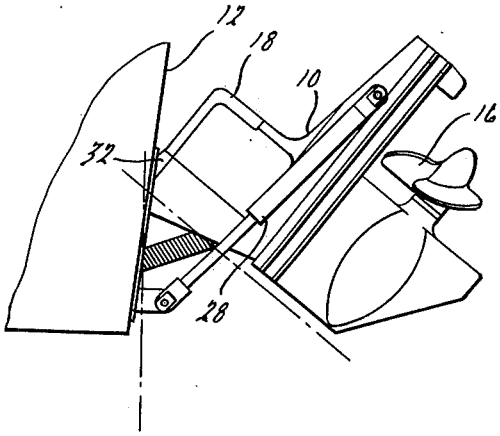

KICK-UP/STEERING CAMMING FEATURE FOR INBOARD-OUTBOARD MARINE DRIVE

BACKGROUND OF THE INVENTION

This invention relates to inboard-outboard (I/O) marine drive units for boats wherein an inboard engine has a rearwardly extending drive shaft coupled through universal joints to power transmission means in an outboard power leg having an upper gear housing and a propeller carried at the lower end of the power leg. The outboard power leg is carried aft of the stern and is mounted for pivoting on two mutually and generally perpendicular axes. It is therefore free to swing laterally for steering the boat while also being free to swing vertically such that the lower end thereof may move rearwardly and upwardly in a tilting, trimming and/or kick-up motion.

In certain instances it has been found desirable to mount the power leg relative to the transom such that the forward portion of the upper gear housing extends slightly into the transom opening. In such an arrangement the lateral turning of the power leg and its vertical swinging on kick-up require a relatively large transom opening in order to avoid contact between the power leg upper gear housing and the inner peripheral edges of the transom opening. At times, kick-up movement can be quite violent and potentially harmful if contact occurs between the unit and transom.

However, the use of a slightly large transom opening is in some cases unsightly and has been found in some cases to prohibit the use of the aforementioned inboard marine mounting arrangement on boats having small transoms.

SUMMARY OF THE INVENTION

In view of the above, it is an object of this invention to provide inboard-outboard marine drive arrangements of the foregoing type wherein a small transom opening may be used to receive the forward portion of an I/O upper gear housing while avoiding the possibility of harmful damage to the transom or to the outboard power leg upon the occurrence of kick-up of the unit.

This is accomplished by providing camming portions proximate the inner peripheral edge of the transom opening. These camming portions are positioned such that upon kick-up, in the event the power leg is turned, the upper gear housing contacts a camming portion and is guided in its upward motion by riding against the camming portion. The transom camming portions are so shaped as to urge the power leg to a lesser turning angle as it swings upwardly due to kick-up. The upward movement of the power leg in such an arrangement results in a turning of the power leg on its steering axis toward a central position amidships as it swings upwardly. This arrangement provides for dissipation of the violent kick-up forces by utilizing them to turn the unit during its upward movement.

In its preferred embodiment, a cam follower portion is included on the sides of the upper gear housing which engage the camming portion on the transom during kick-up.

In its most preferred embodiment resilient structural material means will be utilized on either or both the transom camming portions and the power leg cam follower portions.

Other features of the invention will become apparent below.

BRIEF DESCRIPTION OF THE DRAWING

FIG. 1 is a perspective stern view of a boat with an inboard-outboard drive unit embodying the invention.

FIG. 2 is a partially broken away port elevation of a boat with an inboard-outboard drive unit in a raised position;

FIG. 3 is a top plan view of a stern portion of a boat having an inboard-outboard drive unit in a turning position;

DESCRIPTION OF THE PREFERRED EMBODIMENT

Figure 4:
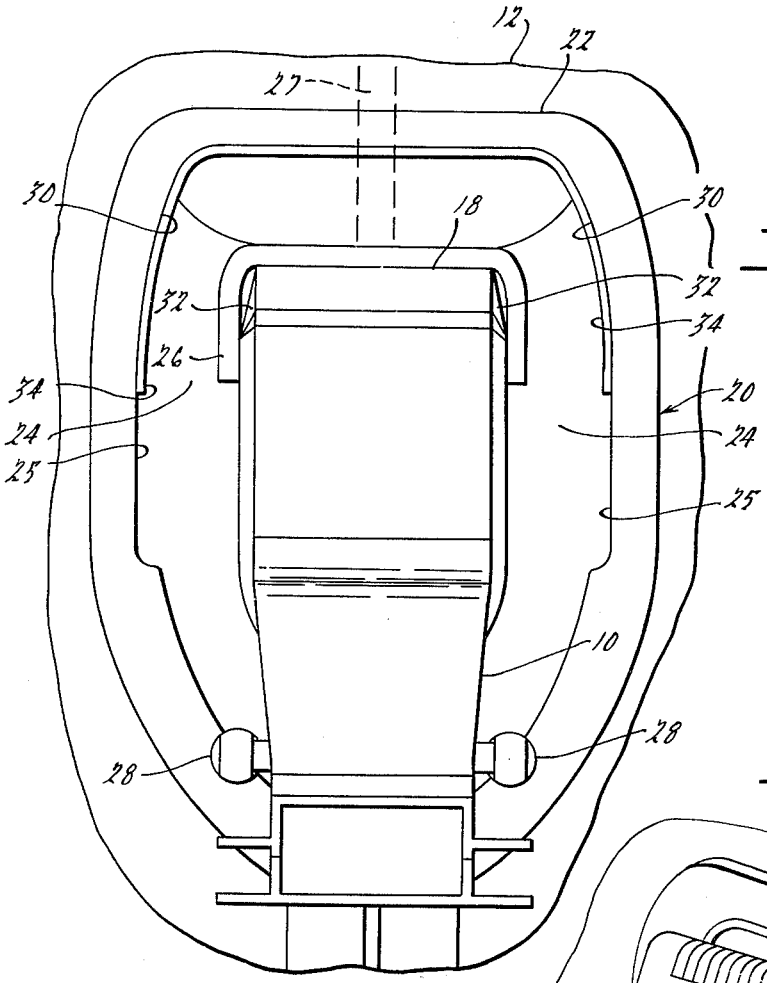
FIG. 4 is a rear elevation of a stern portion of a boat showing the transom opening and the outboard power leg of the I/O unit.

Referring to the drawing Figures, the inboard-outboard unit includes outboard power leg 10 carried aft of stern transom 12, on a partially shown boat 12. Outboard power leg 10 includes a propeller 16 which is drivingly connected through upper gear housing 18 to drive shaft means (not shown) which is connected to an inboard engine (not shown) carried inside the boat.

The mounting means for outboard power leg 10 associated with the boat between the engine and outboard power leg primarily at the transom, comprises a transom shield casting generally designated at 20 which includes an outer peripheral flange portion 22 and an inner cupped portion 24 which together form a peripheral edge 25. Casting 20 fits into an opening in transom 12 and in turn provides an opening, due to its cupped shape at 24, into which the forward portion of upper gear housing 18 may be inserted for mounting on an inverted yoke member 26. There is thus provided an opening in the transom into which the forward portion of the upper gear housing 18 of power leg may extend for mounting to the boat. Inverted yoke 26 is pivotally connected by a central and upwardly extending center leg 27 such that power leg 10 and yoke 26 may be turned laterally relative to the boat to provide a turning or steering action as is shown in FIG. 3 of the drawing in which power leg 10 is turned to port. Since power leg 10 is pivotally carrried by yoke 26, it may also be raised upwardly by swinging on the yoke as is shown in FIG. 2 of the drawing. This upwardly swinging movement may be the result of a trimming or tilting motion provided by the hydraulic cylinders 28 or may be the result of kick-up action which occurs when power leg 10 strikes an object in the water. Kick-up is usually caused at relatively high speeds and thus results in a violent upward movement of power leg 10 on yoke 26.

As can be seen in FIG. 4, the opening provided by transom shield 20 is generally oval in shape and elongated vertically. There is therefore more room between the upper horizontal surface of gear housing 18 and the inner peripheral edge 25 at the top that at the sides. Ordinarily, if kick-up should occur, when the boat is proceeding in a forward direction with the power leg centered it will lift straight up and the propeller thrust and weight of the unit will tend to dissipate the kick-up force during lifting before the upper gear housing reaches the top of its travel which is controlled by the hydraulic cylinders. However, due to the inwardly curving inner peripheral edges of the transom opening as defined by flange portion 22 and cupped portion 24 of transom shield 20, if kick-up occurs when the unit is turned either to port or to starboard, as is shown for example in FIG. 3, engagement may occur between upper gear housing 18 and some point on inner peripheral edge portion 25.

This invention makes use of this engagement caused by kick-up during turning to dissipate the kick-up forces by causing the unit to turn on its steering axis. To this end there is provided a cam portion 30 on the transom shield at each side of the power leg upper gear housing 18. Cam portions 30 may constitute the inner peripheral edge 25 of transom shield 20 at the upper half of the oval opening. Cam follower portions 32 are included on opposite sides of the upper gear housing 18 for respectively engaging one of the cam portions 30 upon turning of power leg 10 about its vertical axis in either direction and which upon kick-up causes engagement between a cam portion 30 and a cam follower portion 32, respectively. Cam portions 30 are arcuately shaped such that as power leg 10 swings upwardly on its horizontal axis at kick-up when a cam portion 30 and cam follower portion 32 engage power leg 10 is continually urged toward a lesser turning angle as cam follower portion 32 rides upwardly against cam portion 30 whereby the forces generating the kick-up motion tend to be dissipated by the turning of the power leg 10.

Figure 5:
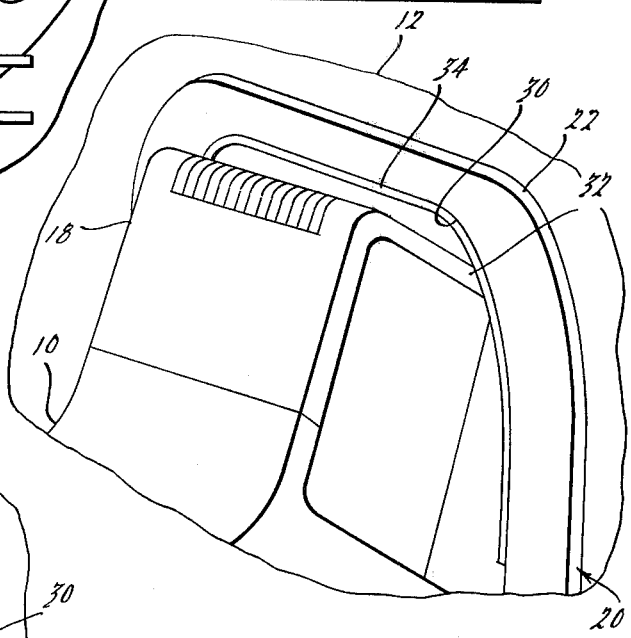
FIGS. 5 and 6 are rear perspective fragmentry views of the power leg upper gear housing of an I/O unit in the raised and turning positions, showing engagement of the upper gear housing against the inner peripheral edge of the transom opening.
Figure 6:
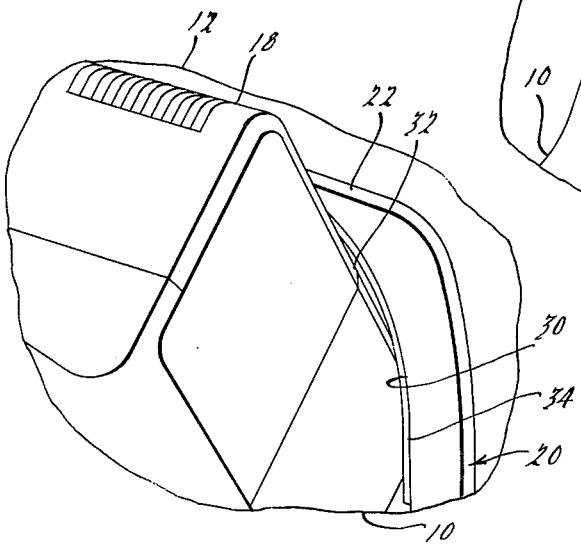

This action can be understood by referring to FIGS. 5 and 6. In FIG. 5 engagement between cam follower 32 and cam portion 30 is occurring as upper gear housing 18 moves upwardly due to kick-up during a turn. Comparing FIG. 6 with FIG. 5 it can be seen that cam follower portion 32 has riden upwardly on arcuate cam portion 30 during the rising movement of the power leg thus causing it to rotate on its steering axis to a lesser turning angle.

In the most preferred embodiment a body of smooth resilient material such as hard rubber, nylon, teflon or the like will be included as at 34 to provide a resilient bumper arrangement between cam portion 30 and cam follower portion 32. The resilient material may be included on either the transom mounting means or on the upper gear housing or on both.

What is claimed is:

1. In an article of manufacture for use with an inboard engine and a rearwardly extending drive means in a boat, an outboard power leg including an upper gear housing and a propeller means driven by the drive means through the upper housing, a transom mounting means through which the drive means extends for connection within the upper gear housing, pivot means connecting the power leg to the trnasom mounting means for movement about both a generally vertical turning axis and a generally horizontal kick-up axis, the improvement comprising a pair of cam portions associated with the transom mounting means and oppositely disposed one to each side of the upper gear housing, and a pair of cam follower portions associated with opposite sides of the upper gear housing for respectively engaging one of the cam portions upon turning of the power leg about the vertical axis in either direction through an angle which upon kick-up causes engagement between a cam portion and a cam follower portion respectively, the cam portion being so shaped that, as the power leg swings upwardly on its horizontal axis in a kick-up motion when a cam portion and a cam follower portion are engaged, the power leg is continually urged toward a lesser turning angle as the cam follower portion rides upwardly against the cam portion during the kick-up motion whereby the forces generating the kick-up motion tend to be dissipated by turning of the power leg.

2. The article according to claim 1 wherein the transom mounting means is provided with an opening into which a forward portion of the upper gear housing extends, the opening having arcuate sides at least at its upper half which provide the cam surface portions for engaging the upper gear housing cam follower portions.

3. The article according to claim 1 wherein the cam portions include resilient bumper means.

4. The article according to claim 1 wherein the cam follower portions include resilient bumper means.

5. The article according to claim 1 wherein both the cam portions and the cam follower portions include resilient bumper means.

6. The article according to claim 1 wherein the upper gear housing has oppositely disposed upper lateral beveled edges which provide the cam follower portions.

* * * * *